US008186271B2

(12) United States Patent
Kwon et al.

(10) Patent No.: US 8,186,271 B2
(45) **Date of Patent: *May 29, 2012**

(54) METHOD FOR MANUFACTURING PRINTING PLATE

(75) Inventors: Oh Nam Kwon, Gyeonggi-do (KR); Heung Lyul Cho, Gyeonggi-do (KR); Seung Hee Nam, Gyeonggi-do (KR)

(73) Assignee: LG Display Co., Ltd., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 13/023,306

(22) Filed: Feb. 8, 2011

(65) Prior Publication Data

US 2011/0129605 A1 Jun. 2, 2011

Related U.S. Application Data

(62) Division of application No. 11/474,364, filed on Jun. 26, 2006, now Pat. No. 7,908,967.

(30) Foreign Application Priority Data

Aug. 25, 2005 (KR) ..... 10-2005-0078212

(51) Int. Cl.
*B44C 1/22* (2006.01)

(52) U.S. Cl. ..... 101/401.1

(58) Field of Classification Search ..... 101/401.1; 430/270.1

See application file for complete search history.

(56) References Cited

U.S. PATENT DOCUMENTS

| | | | | |
|---|---|---|---|---|
| 4,233,109 | A | 11/1980 | Nishizawa | |
| 5,609,704 | A | 3/1997 | Hayama et al. | |
| 6,608,437 | B1 | 8/2003 | Kishi et al. | |
| 7,390,422 | B2 | 6/2008 | Yoo et al. | |
| 7,908,967 | B2 * | 3/2011 | Kwon et al. | 101/401.1 |
| 2003/0024896 | A1 | 2/2003 | Hineman et al. | |

FOREIGN PATENT DOCUMENTS

| | | | |
|---|---|---|---|
| JP | 2-70435 | | 3/1990 |
| JP | 7-117207 | | 5/1995 |
| JP | 11198337 | A * | 7/1999 |
| JP | 11-291438 | | 10/1999 |
| JP | 2004-518563 | | 6/2004 |
| WO | 02/066251 | | 8/2002 |

* cited by examiner

*Primary Examiner* — Ren Yan
*Assistant Examiner* — Shema Freeman
(74) *Attorney, Agent, or Firm* — Morgan, Lewis & Bockius LLP

(57) ABSTRACT

A method for manufacturing a printing plate includes forming first trenches having a first depth into an insulative substrate, forming an organic film over the insulative substrate including the first trenches, and forming second trenches having a width smaller than that of the first trenches into the organic film, the second trenches formed at positions corresponding to the first trenches by selectively removing the organic film.

6 Claims, 7 Drawing Sheets

METHOD FOR MANUFACTURING PRINTING PLATE

This application is a divisional of application Ser. No. 11/474,364 filed Jun. 26, 2006, now U.S. Pat. No. 7,908,967 which claims prior under 35 USC 119 from Korean Patent Application No. P2205-078212 filed Aug. 25, 2005, both of which are hereby incorporated by reference in their entirety.

BACKGROUND OF THE INVENTION

1. Field of the Invention

The present invention relates to printing, and more particularly, to a method for manufacturing a printing plate. Although the present invention is suitable for a wide scope of applications, it is particularly suitable for a method for manufacturing a printing plate that can form a fine pattern.

2. Discussion of the Related Art

Liquid crystal display (LCD) devices, which have image quality equivalent to that of a cathode ray tube, are used in a wide variety of applications because of their advantage of light-weight, thin profile, and compact size. In general, a liquid crystal display device includes an array substrate, a color filter substrate and liquid crystal molecules between the substrates such that pixels in a matrix are respectively controlled to display images. The array substrate has a plurality of gate lines and data lines crossing each other to define pixel areas, pixel electrodes made of a transparent metal respectively formed in the pixel areas and TFTs serving as switching units for the pixel electrodes, and a color filter substrate having a transparent insulative substrate, a black matrix layer, and RGB color filter layers formed on the transparent insulative substrate opposite to pixel electrodes of the array substrate. The array substrate and the color filter substrate are bonded to each with liquid crystal molecules interposed therebetween.

The array substrate and the color filter substrate are independently manufactured. Before the array substrate and the color filter substrate are bonded to each other, an orientation film depositing step, a rubbing step, a spacer distributing step, and a seal printing step are performed. When these steps are finished, the array substrate and the color filter substrate are positioned opposite to each other, and then bonded to each other by applying heat and/or irradiating ultraviolet rays.

The seal printing step is performed on the array substrate to hermetically seal a space between the two substrates to prevent the liquid crystal molecules from flowing out of the space when the liquid crystal molecules are injected into the space. Further, the seal printing step bonds the two substrates to each other. The seal printing step can be performed by using one of four different methods.

The first method is to form a seal pattern by screen printing, which uses simple production equipment and efficiently utilizes the sealing material. Screen printing uses a mask having a patterned screen, which is spaced from the upper surface of a substrate by a designated interval, and then a paste required to form a seal pattern is compressed and transcribed onto the substrate through the patterned screen so that a desired seal pattern is formed on the substrate. Screen printing is being used in the manufacture of LCDs and plasma display panels (PDPs).

Generally, a seal pattern having a height of approximately 20 μm is formed by a screen printing step prior to a baking step to dry the seal pattern. To form a seal pattern having a height of 50~100 μm, the screen printing steps are repeated five times to ten times with baking steps in between to dry a newly printed seal pattern. The repeated printing and baking steps to form a thick seal pattern decrease the productivity of the liquid crystal display. Due to alignment variances over the course of the repeated printing and baking steps, a seal pattern with a thin profile is difficult to obtain. Further, reproducibility in terms of achieving a desired height with a desired number of repeated printing and baking steps is not consistent.

The second method is to selectively sand blast sealing material that has been spread on the substrate to form the desired seal pattern. The sand blast method is used to form a fine seal pattern in the manufacturing of a large-sized panel. For example, sealing material is printed over the whole surface of a substrate having electrodes formed thereon using a screen printing method, a photosensitive film is applied to the sealing material, and only portions of the photosensitive film for protecting the sealing material are left on the sealing material through an exposure and development process. Then, an abrading agent is sprayed at the sealing material on the substrate to remove portions of the sealing material, which are not protected by the photosensitive film. $Al_2O_3$, SiC, or ultrafine particles of glass can be used as the abrading agent, and the abrading agent can be sprayed by using compressed air or nitrogen gas.

The sand blast method is used to form a sealing pattern having a height of less than 70 μm on a large-sized glass substrate. The sand blast method mechanical impacts the substrate with the abrading material such that microscopic damage can occur in the substrate that later develop into cracks in the substrate during baking. Further, the sand blast method raises production costs due to consumption of many materials uses costly equipment. In addition, the sand blast method is complicated and causes dust pollution.

The third method is to spray the seal pattern directly onto a substrate by dispensing the sealing material with pressurized air pressure through a template. The dispenser method eliminates the costs of using a photoresist mask and a seal pattern can be deposited as a thick film because the sealant material starts drying while airborne. Further, the dispenser method is a simple procedure and can be used for applying a seal pattern in large-sized LCDs and PDPs.

The fourth method is to plate print the seal pattern. FIGS. 1A to 1C are cross-sectional views illustrating a printing process for forming a set of patterns on a substrate according to the related art. As shown in FIG. 1A, a pattern material 20 is applied to a printing roll 10 using a printing nozzle 30.

As shown in FIG. 1B, the printing roll 10, to which the pattern material 20 is applied, is applied to a printing plate 40, in which a designated figure is engraved. Then, a part 20*b* of the pattern material 20 is transcribed on protrusions of the printing plate 40, and the other part 20*a* of the pattern material 20 remains on the printing roll 10.

As shown in FIG. 1C, the printing roll 10 having the remaining pattern material 20*a* then is rotated on a substrate 50, thereby transcribing the remaining pattern material 20*a* on the substrate 50.

A plate printing apparatus can be used to form letters and designs on a wrapping paper. However, the plate printing apparatus may be used for other purposes, such as formation of a thin film. For example, the plate printing apparatus can be used to form an orientation film of a liquid crystal display device by printing a polyimide thin film on a glass plate, or to form a seal pattern for a liquid crystal panel. Hereinafter, with reference to the accompanying drawings, a related art method for manufacturing a printing plate for a plate printing apparatus will be described.

FIGS. 2A to 2E are cross-sectional views illustrating a method for manufacturing a printing plate according to the related art. As shown in FIG. 2A, a metal film 52 for a hard mask is deposited on an insulative substrate 51, and a photoresist 53 then is applied to the metal film 52. The metal film 52 is made of a metal, such as Cr or Mo. Subsequently, the photoresist 53 is selectively patterned through photolithography process, including exposure, thereby defining pattern regions.

As shown in FIG. 2B, the metal film 52 is selectively removed using the patterned photoresist 53 as a mask, thereby forming a metal film pattern 52*a* (or hardmask).

As shown in FIG. 2C, the photoresist 53 is removed from the insulative substrate 51. The removal of the photoresist 53, which is used as a mask for forming the metal film pattern 52*a*, is performed by a method using oxygen gas plasma or a method using an oxidizer. In the oxygen gas plasma method, oxygen gas is injected onto a substrate under a vacuum and a high-voltage bias over the substrate generates an oxygen gas plasma that reacts with the photoresist to remove the photoresist by decomposition.

As shown in FIG. 2D, the insulative substrate 51 is selectively etched using the metal film pattern 52*a* as a mask, thus forming trenches 54 having a depth of approximately 20 μm into the surface of the insulative substrate 51. Isotropic etching using a HF-group etchant can be performed on the insulative substrate 51.

As shown in FIG. 2E, the metal film pattern 52*a* is removed from the insulative substrate 51.

The printing plate, which is manufactured by the above method, is used in the printing apparatus of FIG. 1B. Then, a desired printing material is coated on the printing roll, the printing material on the printing roll is selectively printed on the printing plate, and the printing material on the printing plate is transcribed onto the object to be printed, thus producing the desired pattern.

The above related art method for manufacturing the printing plate has disadvantages. For example, since the trenches having a desired depth are simultaneously formed in the insulative substrate by etching the insulative substrate using the metal film pattern as a mask, the etching critical dimension (CD) increases due to the characteristics of isotropic etching, thus causing a difficulty in manufacturing a fine printing plate. In other words, the width of an etch increases faster than the depth of an etch during etching. In general, the width of an etched trench is at least twice as much as the depth of an etched trench. Thus, when the etch depth into the insulative substrate is 5 μm, it is impossible to form a line width (A of FIG. 2D) of less than 10 μm.

SUMMARY OF THE INVENTION

Accordingly, the present invention is directed to a method for manufacturing a printing plate that substantially obviates one or more of the problems due to limitations and disadvantages of the related art.

An object of the present invention is to provide a method for manufacturing a printing plate with a decreased etching critical dimension.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a method for manufacturing a printing plate includes forming first trenches having a first depth into an insulative substrate, forming an organic film over the insulative substrate including the first trenches, and forming second trenches having a width smaller than that of the first trenches into the organic film, the second trenches formed at positions corresponding to the first trenches by selectively removing the organic film.

In another aspect, a method for manufacturing a printing plate includes forming first trenches into an insulative substrate, forming an organic film over the whole surface of the insulative substrate, forming second trenches into the organic film in the first trenches, and forming a cover layer over the insulative substrate and the organic film including the second trenches to define a printing pattern.

In yet another aspect, a method for manufacturing a display panel includes dispensing a printing material on a print roll, rotating the print roll on a print plate to remove a portion of the printing material, the print plate having trenches into an organic film and at least one of the trenches having a width smaller than its depth, and transcribing a remaining portion of the printing material on the print roll into patterns on a substrate, the patterns corresponding to the trenches of the print plate.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENTS

Reference will now be made in detail to the preferred embodiments of the present invention, examples of which are illustrated in the accompanying drawings. Wherever possible, the same reference numbers will be used throughout the drawings to refer to the same or like parts.

Figure 1A:
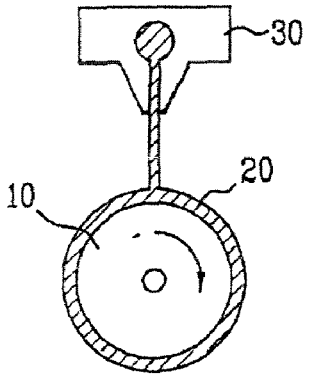
FIG. 1A Related Art
FIGS. 1A to 1C are cross-sectional views illustrating a printing process for forming a set of patterns on a substrate according to the related art.
Figure 1B:
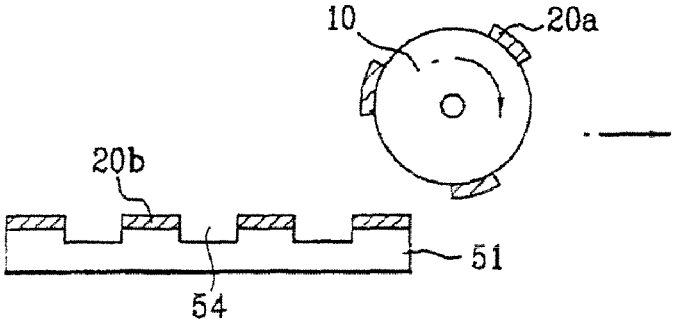
FIG. 1B Related Art
Figure 1C:
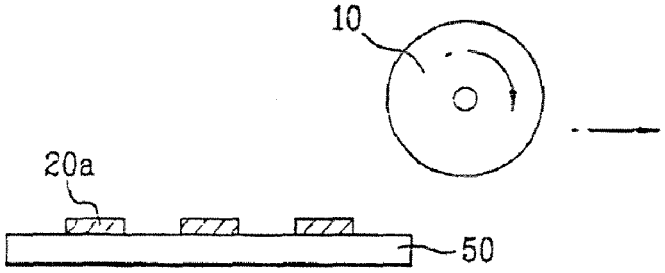
FIG. 1C Related Art
Figure 2A:
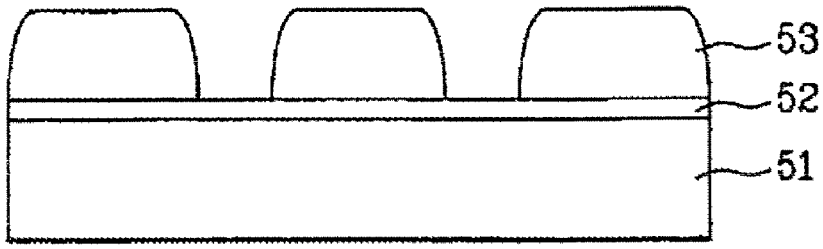
FIG. 2A Related Art
FIGS. 2A to 2E are cross-sectional views illustrating a method for manufacturing a printing plate according to the related art.
Figure 2B:
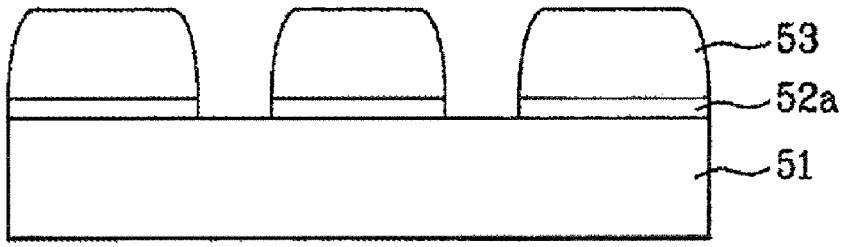
FIG. 2B Related Art
Figure 2C:
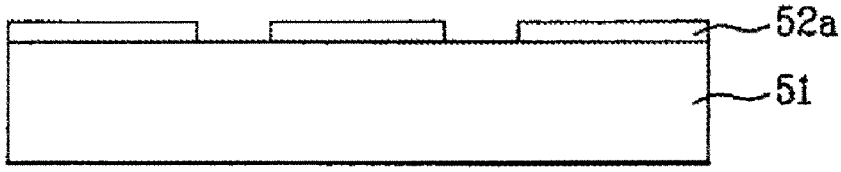
FIG. 2C Related Art
Figure 2D:
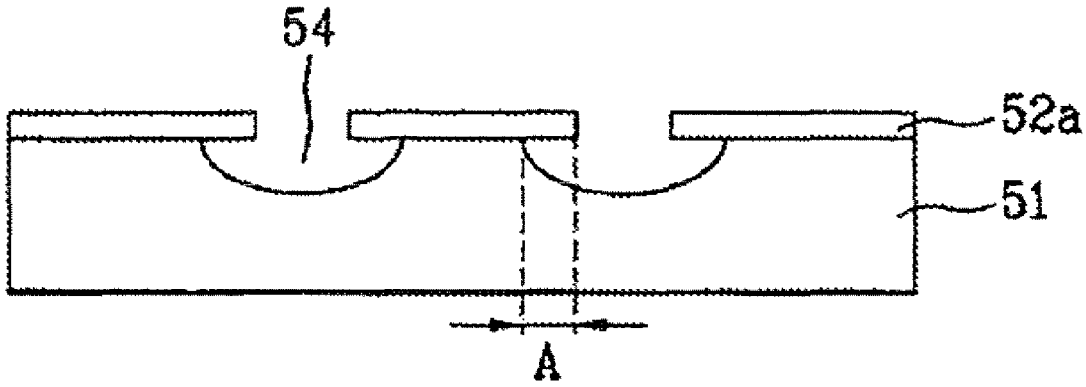
FIG. 2D Related Art
Figure 2E:
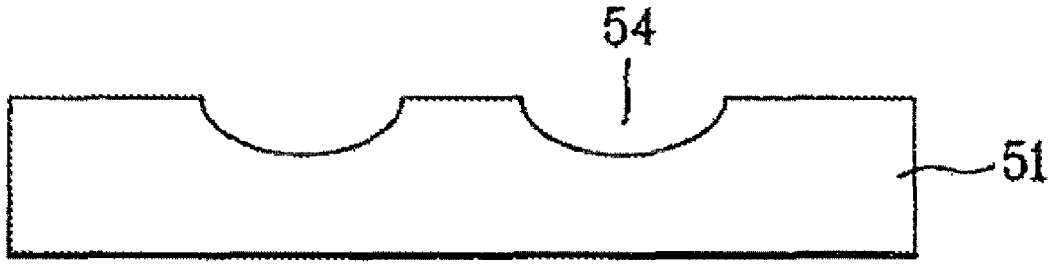
FIG. 2E Related Art
Figure 3A:
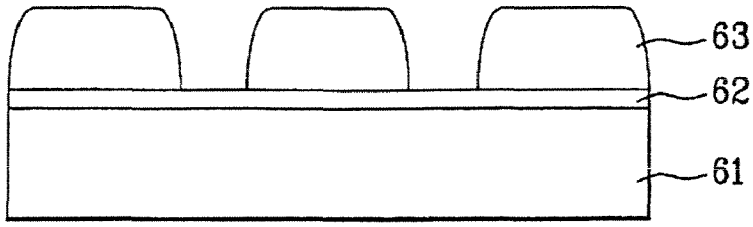
FIGS. 3A to 3I are cross-sectional views illustrating a method for manufacturing a printing plate in accordance with an embodiment of the present invention.

FIGS. 3A to 3I are cross-sectional views illustrating a method for manufacturing a printing plate in accordance an embodiment of the present invention. As shown in FIG. 3A, a first metal film 62 for a hard mask is deposited on an insulative substrate 61, and then a photoresist 63 is applied to the first metal film 62. The first metal film 62 may include one of chromium (Cr) and molybdenum (Mo). Thereafter, the photoresist 63 is selectively patterned through a photolithography process, including exposure, thereby defining pattern regions.

Figure 3B:
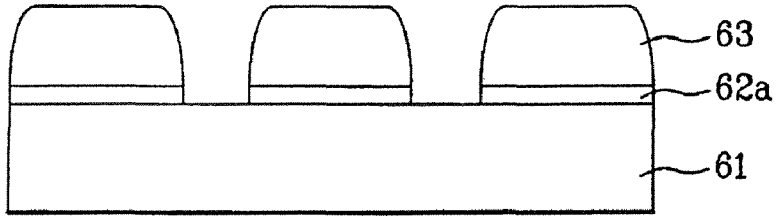

As shown in FIG. 3B, the first metal film 62 is selectively removed using the patterned photoresist 63 as a mask, thereby forming a first metal film pattern 62*a*.

Figure 3C:
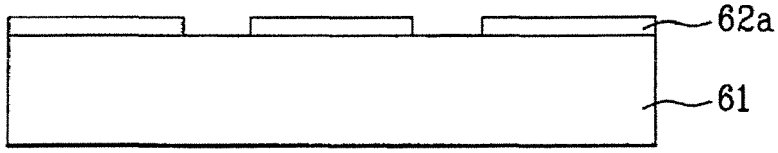

As shown in FIG. 3C, the photoresist 63 is removed from the insulative substrate 61. The removal of the photoresist 63, which is used as a mask for forming the first metal film pattern 62*a*, may be performed by a method using oxygen gas plasma or a method using an oxidizer. For instance, in the oxygen gas plasma method, oxygen gas is injected onto a substrate under a vacuum and a high-voltage bias over the substrate generates an oxygen gas plasma that reacts with the photoresist to remove the photoresist by decomposition.

Figure 3D:
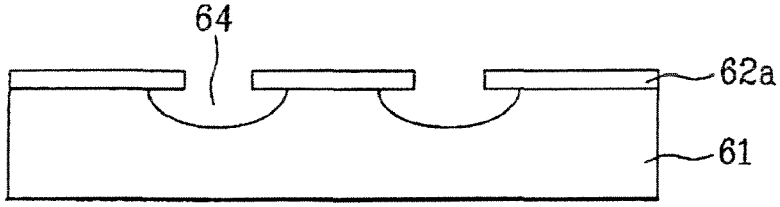

As shown in FIG. 3D, the insulative substrate 61 is selectively etched using the first metal film pattern 62*a* as a mask, thus forming first trenches 64 having a depth of approximately 20 μm, for example, into the surface of the insulative substrate 61. Isotropic etching using a HF-group etchant is performed on the insulative substrate 61. When the first trenches 64 are formed in the insulative substrate 61, an etching critical dimension ('CD') is increased due to the characteristics of isotropic etching.

Figure 3E:
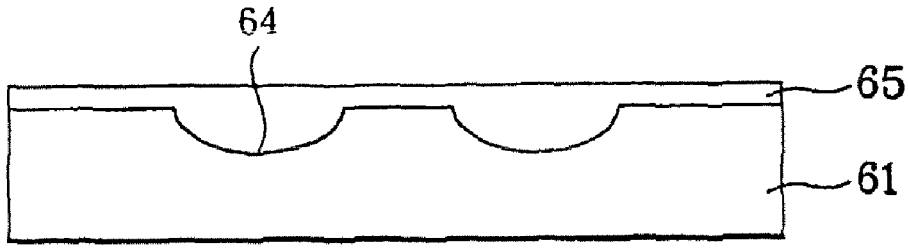

As shown in FIG. 3E, the first metal film pattern 62*a* (shown in FIG. 3D) is removed from the insulative substrate 61, and an organic film 65 is formed over the whole surface of the insulative substrate 61, including the first trenches 64. The organic film 65 may include one or a combination of an acrylic-group material, a BCB-group material and a SOG-group material. The first trenches 64 are completely filled with the organic film 65 due to the planarization characteristics of the organic film 65.

Figure 3F:
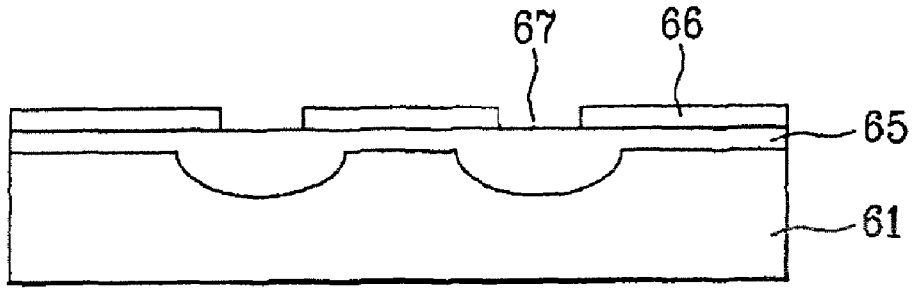

As shown in FIG. 3F, a second metal film 66 for a hard mask is deposited on the organic film 65, and then openings 67 are selectively formed in the second metal film 66 using photolithography and etching, thereby forming a second metal film pattern. The second metal film 66 may include one of chromium (Cr) and molybdenum (Mo). The openings 67 of the second metal pattern correspond to the first trenches 64 in the insulative substrate 61.

Figure 3G:
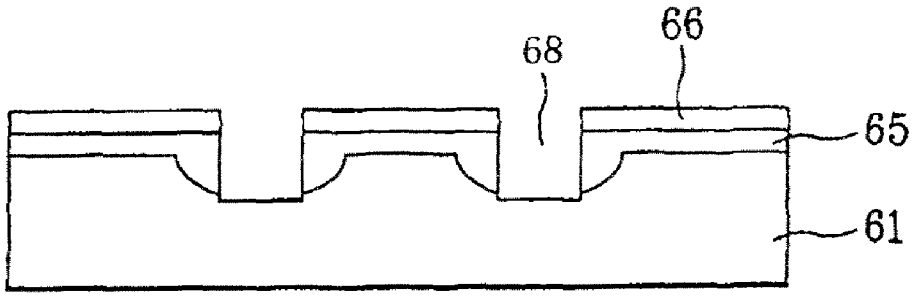

As shown in FIG. 3G, the organic film 65 within the first trenches 64 is selectively etched using the second metal film pattern 66 as a mask to form second trenches 68 in the organic film 65 having a width W2 smaller than the width W1 of the first trenches 64. The second trenches 68 are etched through the organic film 65 to the insulative substrate 61. The organic film 65 is selectively removed through dry etching using an etching gas containing fluorine (F), such as $SF_6$ or $CF_4$ gas.

Figure 3H:
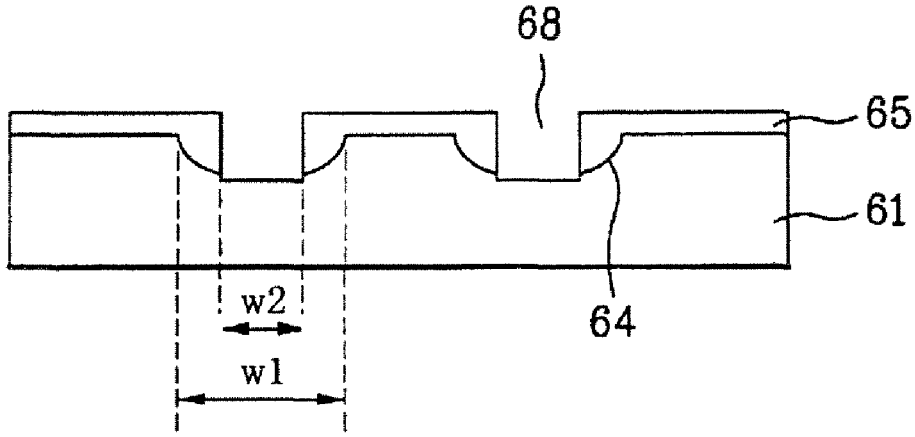

Then, as shown in FIG. 3H, the second metal film pattern 66 is removed from the insulative substrate 61. The first trenches 64 have a width W1 and the second trenches 68 have a width W2, which is smaller than the width W1 of the first trenches 64.

Figure 3I:
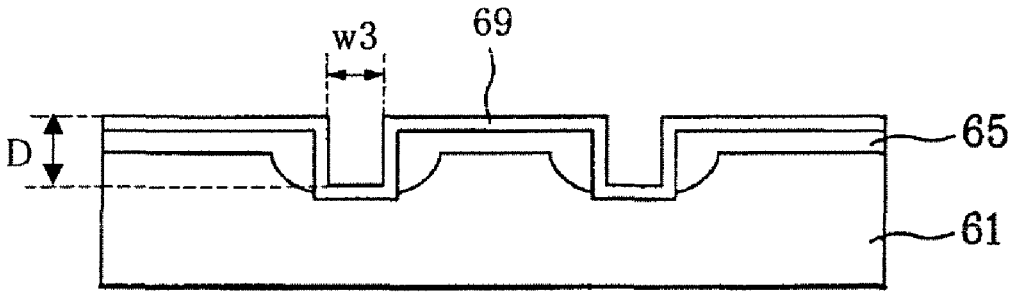

As shown in FIG. 3I, a cover layer 69, such as an inorganic film or a metal film, is formed over the insulative substrate 61 and the organic film 65 having the second trenches 68 formed therein. The cover layer 69 improves the printing characteristics and durability of the printing plate, The cover layer 69 may include one of silicon nitride ($SiN_x$), amorphous silicon (a-Si), and silicon oxide (SiOx). In the alternative, cover layer 69 may include one of chromium (Cr), molybdenum (Mo), aluminum (Al), and copper (Cu). The cover layer-lined second trenches define a printing pattern in the printing plate. The width W3 of the printing pattern is less than the depth D of the printing pattern.

Figure 4A:
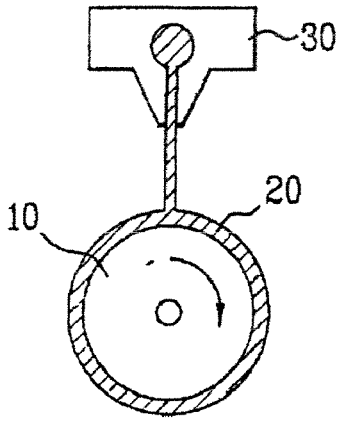
FIGS. 4A to 4C are cross-sectional views illustrating a printing process for forming a set of patterns on a substrate in accordance with an embodiment of the present invention.
Figure 4B:
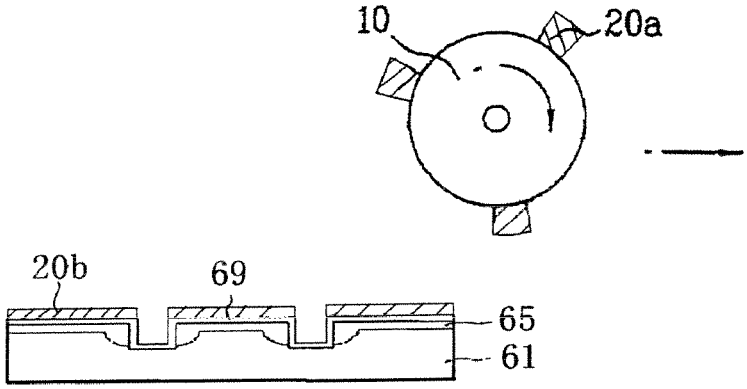
Figure 4C:
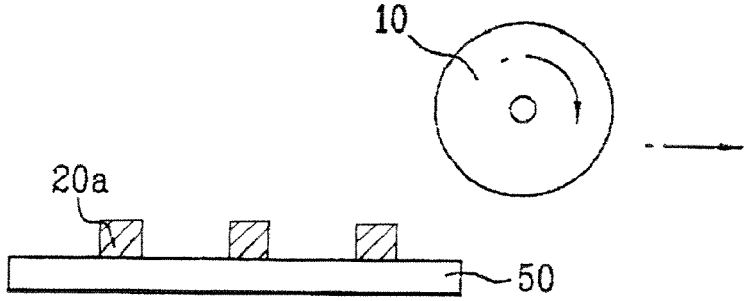

FIGS. 4A to 4C are cross-sectional views illustrating a printing process for forming a set of patterns on a substrate in accordance with an embodiment of the present invention. As shown in FIG. 4A, a pattern material 20 is applied to a printing roll 10 using a printing nozzle 30.

As shown in FIG. 4B, the printing roll 10, to which the pattern material 20 is applied, is applied to a printing plate 61, in which a designated figure is engraved. The printing plate 61 may be formed using the method shown in FIGS. 3A to 3I. Then, a part 20*b* of the pattern material 20 is transcribed on protrusions of the printing plate 61, and the other part 20*a* of the pattern material 20 remains on the printing roll 10.

As shown in FIG. 4C, the printing roll 10 having the remaining pattern material 20*a* then is rotated on a substrate 50, thereby transcribing the remaining pattern material 20*a* on the substrate 50.

In the related art method for manufacturing a printing plate, trenches having a designated depth are formed in an insulative substrate by selectively removing the insulative substrate by wet etching. On the other hand, in the method for manufacturing a printing plate in accordance with an embodiment of the present invention, after the first trenches are formed in an insulative substrate by selectively removing the insulative substrate by wet etching, an organic film is formed over the whole surface of the insulative substrate and second trenches having a width smaller than that of the first trenches are formed in the organic film by selectively removing the organic film by dry etching. Thus, a printing plate is manufactured to have a decreased critical dimension in which the width of a pattern is less than the depth of the pattern. For example, a printing plate may be manufactured to form a pattern having a width less than 10 μm or to form patterns having a resolution less than 10 μm. Accordingly, a printing plate with a fine pattern can be manufactured.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A method for manufacturing a display panel comprising:

dispensing a printing material on a print roll;

rotating the print roll on a print plate to remove a portion of the printing material; and transcribing a remaining portion of the printing material on the print roll into patterns on a substrate, wherein the printing plate comprising:

first trenches each having a first depth into an insulative substrate;

second trenches each having a width smaller than that of each of the first trenches and smaller than a depth of the second trenches, the second trenches corresponding to the patterns; and an organic film formed at an area other than the each second trench into the each first trench and at area between the first trenches after forming the second trenches, wherein the second trenches are formed into the organic film in the first trenches by selectively removing the organic film in the first trenches.

2. The method as set forth in claim 1, wherein the width of the second trench is less than 10 μm.

3. The method as set forth in claim 1, wherein resolution of the patterns are less than 10 μm.

4. The method as set forth in claim 1, wherein the print plate includes a cover layer over the insulative substrate and the organic film including the second trenches to define a printing pattern.

5. The method as set forth in claim 4, wherein the cover layer includes one of an inorganic film and a metal film.

6. The method as set forth in claim 1, wherein the second trenches are formed in the organic film by selectively removing the organic film in the first trenches through dry etching.

* * * * *